US010233720B2

(12) United States Patent
Tse et al.

(10) Patent No.: US 10,233,720 B2
(45) Date of Patent: Mar. 19, 2019

(54) ACTUATABLE PLUG SYSTEM FOR USE WITH A TUBING STRING

(71) Applicant: Schlumberger Technology Corporation, Sugar Land, TX (US)

(72) Inventors: Kyle Tse, Houston, TX (US); Robert M. Graham, Houston, TX (US); Christopher Cromer, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 51 days.

(21) Appl. No.: 14/957,310

(22) Filed: Dec. 2, 2015

(65) Prior Publication Data

US 2016/0290096 A1 Oct. 6, 2016

Related U.S. Application Data

(60) Provisional application No. 62/144,002, filed on Apr. 7, 2015, provisional application No. 62/143,518, filed on Apr. 6, 2015.

(51) Int. Cl.
*E21B 33/129* (2006.01)
*E21B 33/134* (2006.01)

(52) U.S. Cl.
CPC ..... *E21B 33/134* (2013.01); *E21B 33/129* (2013.01)

(58) Field of Classification Search
CPC ..... E21B 33/129; E21B 33/134
See application file for complete search history.

(56) References Cited

U.S. PATENT DOCUMENTS 2,121,002 A * 6/1938 Baker ..... E21B 33/134 166/120
2,189,697 A * 2/1940 Baker ..... E21B 33/134 166/114
2,217,747 A * 10/1940 Henderson ..... E21B 33/1204 166/126
2,241,561 A * 5/1941 Spencer ..... E21B 33/128 166/134
2,751,018 A * 6/1956 Baker ..... E21B 33/1293 166/134
3,062,295 A * 11/1962 Hanes ..... E21B 33/128 166/63
3,082,824 A * 3/1963 Taylor ..... E21B 33/1293 166/123
3,115,186 A * 12/1963 Kline ..... E21B 33/128 166/135

(Continued)

*Primary Examiner* — Matthew R Buck

(57) ABSTRACT

A technique facilitates deployment and operation of actuatable plugs, e.g. frac plugs or bridge plugs. According to one embodiment, the plug comprises a flexible element slidably mounted on a portion of a cone, e.g. an upper cone. The upper cone comprises a tapered surface which works in cooperation with upper slips movably secured to the upper cone. The bridge plug also comprises a lower cone which comprises a lower tapered surface which works in cooperation with lower slips movably secured to the lower cone. Depending on the application, the plug may be constructed with each of these features combined into an overall assembly or with a portion of these features to facilitate plug operation in a specific environment and operation.

20 Claims, 9 Drawing Sheets

(56) References Cited

U.S. PATENT DOCUMENTS

| | | | | | |
|---|---|---|---|---|---|
| 3,303,885 | A * | 2/1967 | Kisling, III | E21B 33/1293 | 166/134 |
| 3,910,348 | A * | 10/1975 | Pitts | E21B 33/1293 | 166/134 |
| 4,784,226 | A * | 11/1988 | Wyatt | E21B 23/06 | 166/182 |
| 7,017,672 | B2 * | 3/2006 | Owen, Sr. | E21B 23/06 | 166/123 |
| 7,735,549 | B1 * | 6/2010 | Nish | E21B 33/1293 | 166/134 |
| 7,900,696 | B1 * | 3/2011 | Nish | E21B 33/1294 | 166/133 |
| 8,307,892 | B2 * | 11/2012 | Frazier | E21B 33/129 | 166/135 |
| 9,157,288 | B2 * | 10/2015 | Martinez | E21B 23/01 | |
| 2004/0045723 | A1 * | 3/2004 | Slup | E21B 33/1204 | 166/386 |
| 2011/0088891 | A1 * | 4/2011 | Stout | E21B 33/1204 | 166/120 |
| 2012/0217025 | A1 * | 8/2012 | Shkurti | E21B 33/1216 | 166/387 |

* cited by examiner

ACTUATABLE PLUG SYSTEM FOR USE WITH A TUBING STRING

BACKGROUND

In many hydrocarbon well applications, a well is drilled and a plug is used to at least temporarily seal off a portion of the wellbore. The plug may comprise a bridge plug or a frac plug used in fracturing operations. In general, the plug utilizes a rubber element to provide a seal against the surrounding well casing in combination with slips to secure the plug. To set the plug against the well casing, a setting tool is used to compress a rubber element and to cause slips to bite into the surrounding casing. A backup system is used to prevent extrusion of the rubber element and to maintain the integrity of the seal with respect to the well casing. However, the backup system and other elements of the plug can present a relatively complex assembly which is costly to manufacture and sometimes difficult to utilize in certain environments.

SUMMARY

In general, a system and methodology are provided which facilitate deployment and operation of actuatable plugs, e.g. frac plugs or bridge plugs. According to an embodiment, the plug comprises a flexible element slidably mounted on a portion of a cone, e.g. an upper cone. The upper cone comprises a tapered surface which works in cooperation with upper slips movably secured to the upper cone. The bridge plug also comprises a lower cone having a lower tapered surface which works in cooperation with lower slips movably secured to the lower cone. Depending on the application, the plug may be constructed with each of these features combined into an overall assembly or with a portion of these features to facilitate plug operation in a specific environment and operation.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate deployment and operation of actuatable plugs, e.g. frac plugs or bridge plugs. The system and methodology comprise a variety of features which may be combined in whole or in part depending on the specifics of a given operation. For example, certain fracturing operations or other well related operations may benefit from certain features of the actuatable plug embodiments described herein while other operations are suited for use with the entire plug assembly. According to an embodiment, the plug comprises an overall assembly having a flexible element slidably mounted on a portion of a cone, e.g. an upper cone. The upper cone comprises a tapered surface which works in cooperation with upper slips movably secured with the upper cone. The bridge plug also comprises a lower cone which has a lower tapered surface oriented to work in cooperation with lower slips movably secured to the lower cone.

Figure 1:
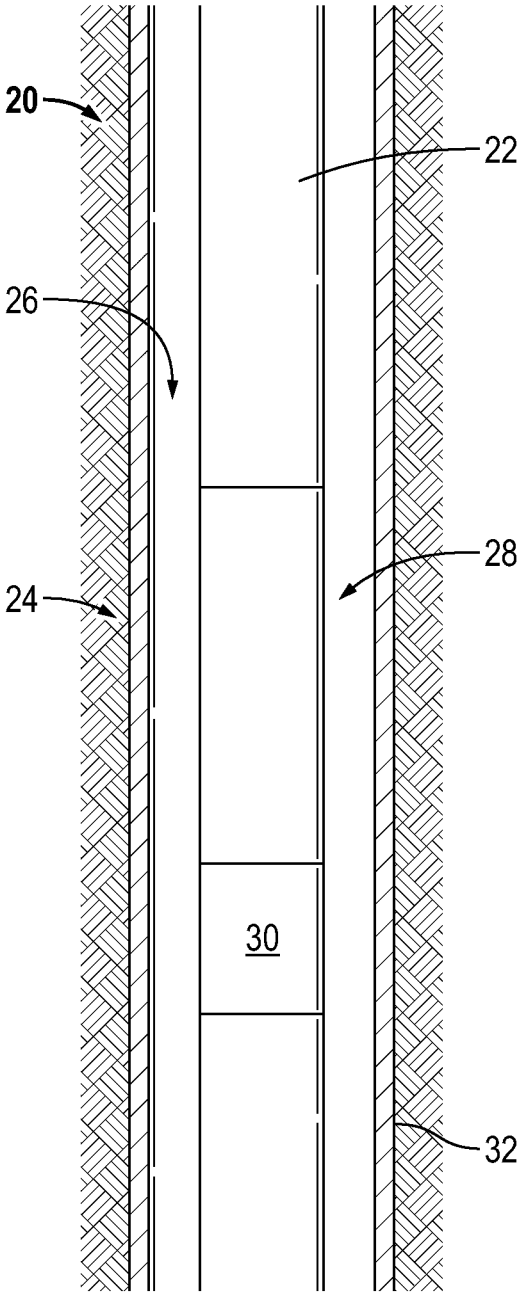
FIG. 1 is a schematic illustration of a well system comprising an actuatable plug, according to an embodiment of the disclosure.

Referring generally to FIG. 1, an embodiment of a well system 20 is illustrated as comprising a tubing string 22 deployed into a well 24. For example, the tubing string 22 may be deployed into a wellbore 26, e.g. a vertical or deviated wellbore, drilled into a subterranean formation. The tubing string 22 comprises various types of well equipment 28 which may selected according to the parameters of a given well operation, e.g. a fracturing operation. Additionally, an actuatable plug 30, e.g. a frac plug or a bridge plug, may be positioned along the tubing string 22 which is deployed into the wellbore 26. In a variety of applications, the plug 30 is constructed for actuation in a manner which expands the plug 30 in a radially outward direction and into sealing engagement with a surrounding well casing 32 disposed along wellbore 26.

Figure 2:
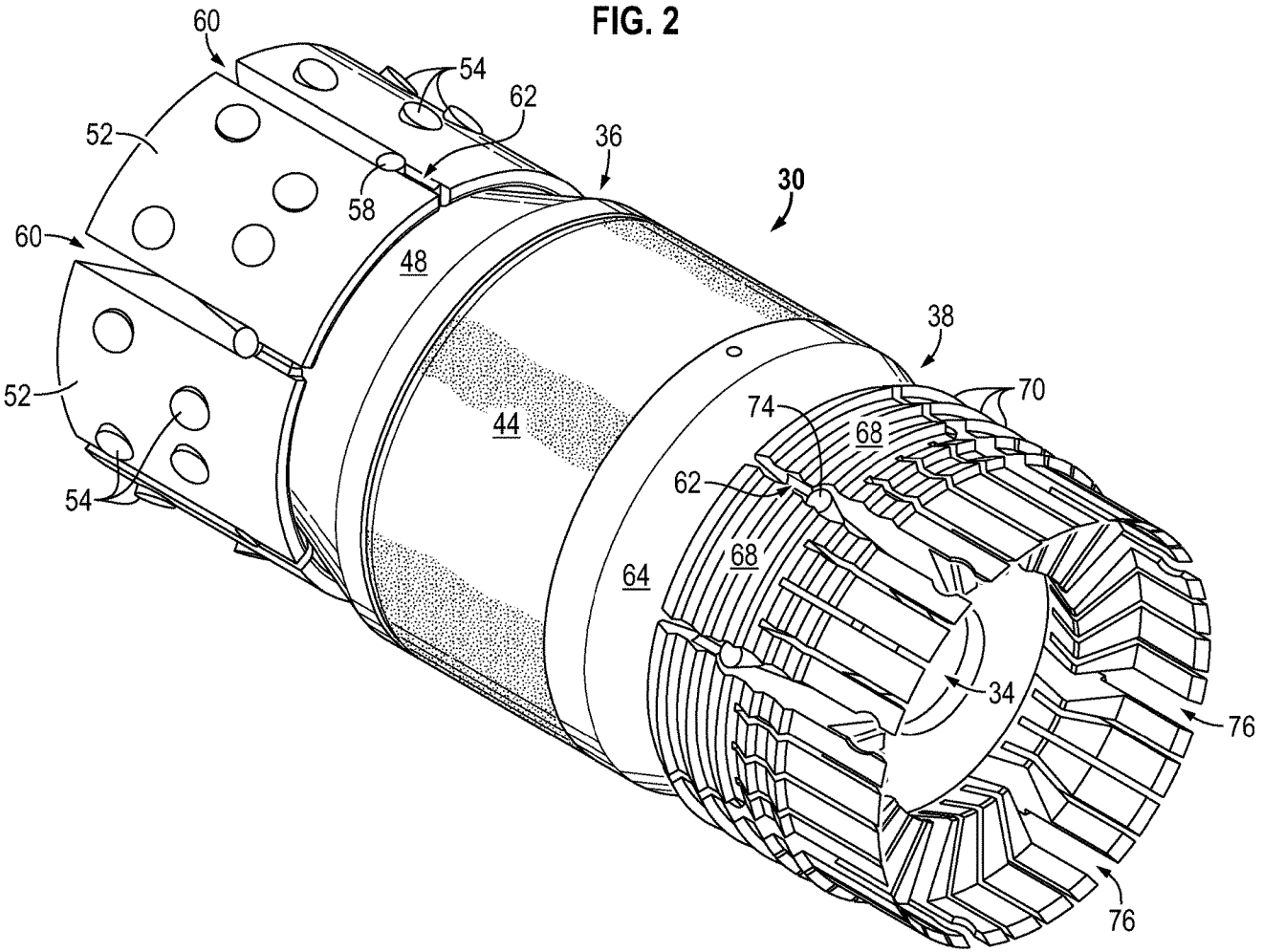
FIG. 2 is an orthogonal view of an example of the plug illustrated in FIG. 1, according to an embodiment of the disclosure.
Figure 3:
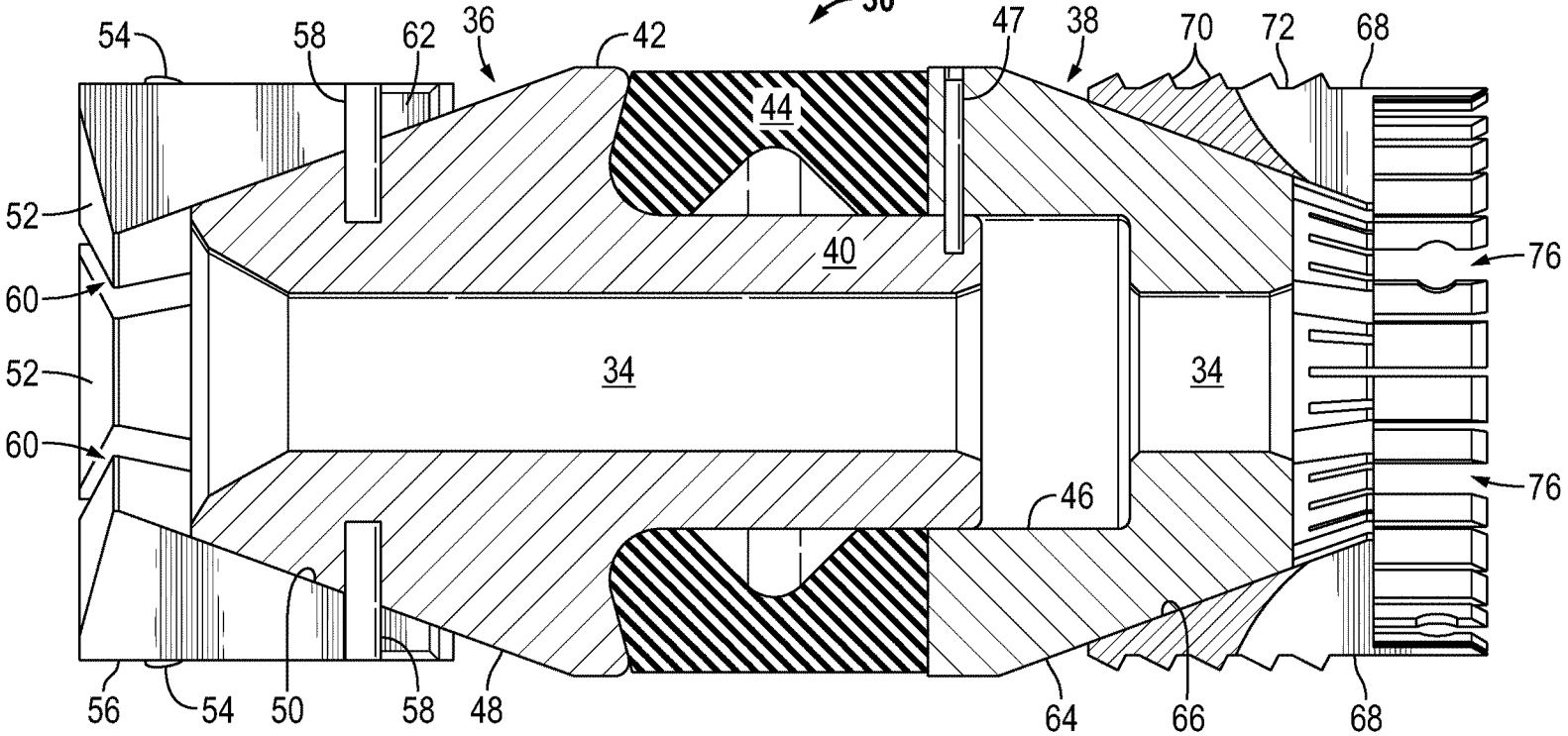
FIG. 3 is a cross-sectional view of the plug illustrated in FIG. 2, according to an embodiment of the disclosure.

Referring generally to FIGS. 2 and 3, an embodiment of plug 30 is illustrated. In this embodiment, plug 30 comprises an internal passage 34, extending longitudinally therethrough, and an upper cone 36 which cooperates with a lower cone 38. It should be noted the terms "upper" and "lower" are used to facilitate explanation and should not be construed as limiting. In some applications, the upper cone 36 is positioned above the lower cone 38, but the plug 30 may be used horizontally, upside down, or in other orientations suitable for a given application.

In the example illustrated, upper cone 36 comprises an extended portion 40 extending from a cone portion 42. The extended portion 40 may be rigidly affixed to cone portion 42 by, for example, integral formation, welding, or threaded engagement. The extended portion 40 extends through an interior of a resilient sealing element 44. In some embodiments, the extended portion 40 may be slidably received by a corresponding recess 46 within lower cone 38 as illustrated. The extended portion 40 may be temporarily held within the corresponding recess 46 via a member 47, e.g. a shear member, until plug 30 is actuated to a radially expanded configuration. The sealing element 44 is used to form a fluid seal with the surrounding well casing 32 when the plug 30 is actuated to a radially expanded configuration. The sealing element 44 may be formed from rubber or another suitable elastomeric material or materials. Suitable materials for forming sealing element 44 may include materials used in the industry to form sealing elements for bridge plugs, frac plugs, or packers. The upper cone 36 also comprises an upper tapered surface 48 formed on cone portion 42 opposite extended portion 40.

The tapered surface 48 is oriented to engage corresponding tapered surfaces 50 of upper slips 52. The upper slips 52 may comprise a plurality of gripping members 54, e.g. teeth, positioned along a radially external surface 56 for engagement with the surrounding well casing 32. The upper slips 52 may be slidably held along tapered surface 48 via retention members 58, e.g. pins, which extend from cone portion 42 and into slots 60 located between adjacent upper slips 52. When plug 30 is in the non-actuated configuration as illustrated in FIGS. 2 and 3, the upper slips 52 are held together by bridge portions 62 which prevent the slips 52 from sliding off the tapered surface 48 of upper cone 36. By way of example, the bridge portions 62 may be formed of frangible material extending between adjacent upper slips 52.

As illustrated, the lower cone 38 comprises a lower tapered surface 64. The lower tapered surface 64 is oriented to engage corresponding tapered surfaces 66 of lower slips 68. The lower slips 68 may comprise a plurality of lower slip gripping members 70, e.g. teeth, positioned along a radially external surface 72 of the lower cone 38 for engagement with the surrounding well casing 32. The lower slips 68 may be slidably held along tapered surface 64 via retention members 74, e.g. pins, which extend from lower cone 58 and into slots 76 located between adjacent lower slips 68. When plug 30 is in the non-actuated configuration as illustrated in FIGS. 2 and 3, the lower slips 68 also may be held together by bridge portions 62 which prevent the lower slips 68 from sliding off the tapered surface 64 of lower cone 38. As with the upper cone bridge portions 62, the lower cone bridge portions 62 may be formed of frangible material extending between adjacent lower slips 68.

Figure 4:
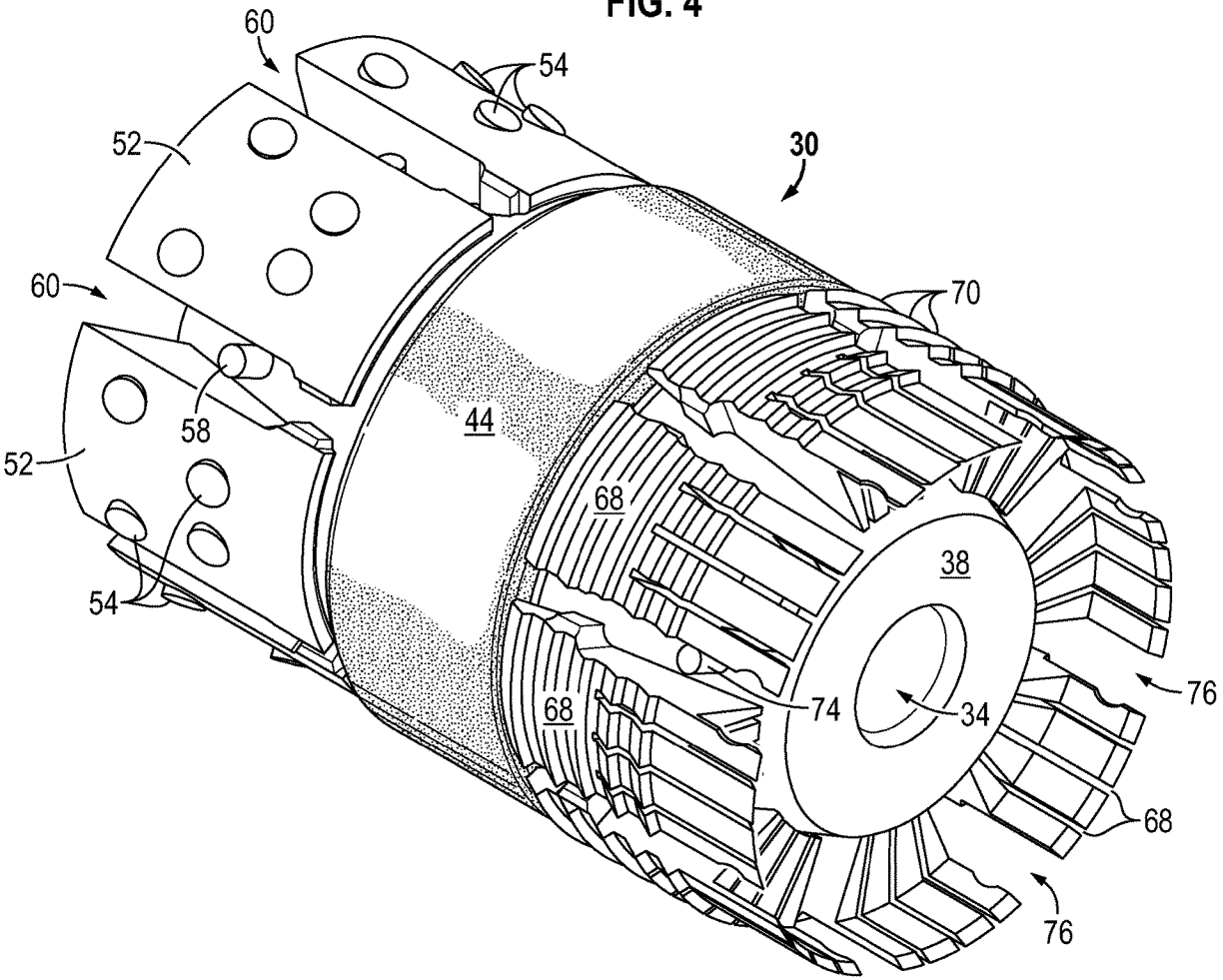
FIG. 4 is another orthogonal view of the plug illustrated in FIG. 2 but in a different operational configuration, according to an embodiment of the disclosure.
Figure 5:
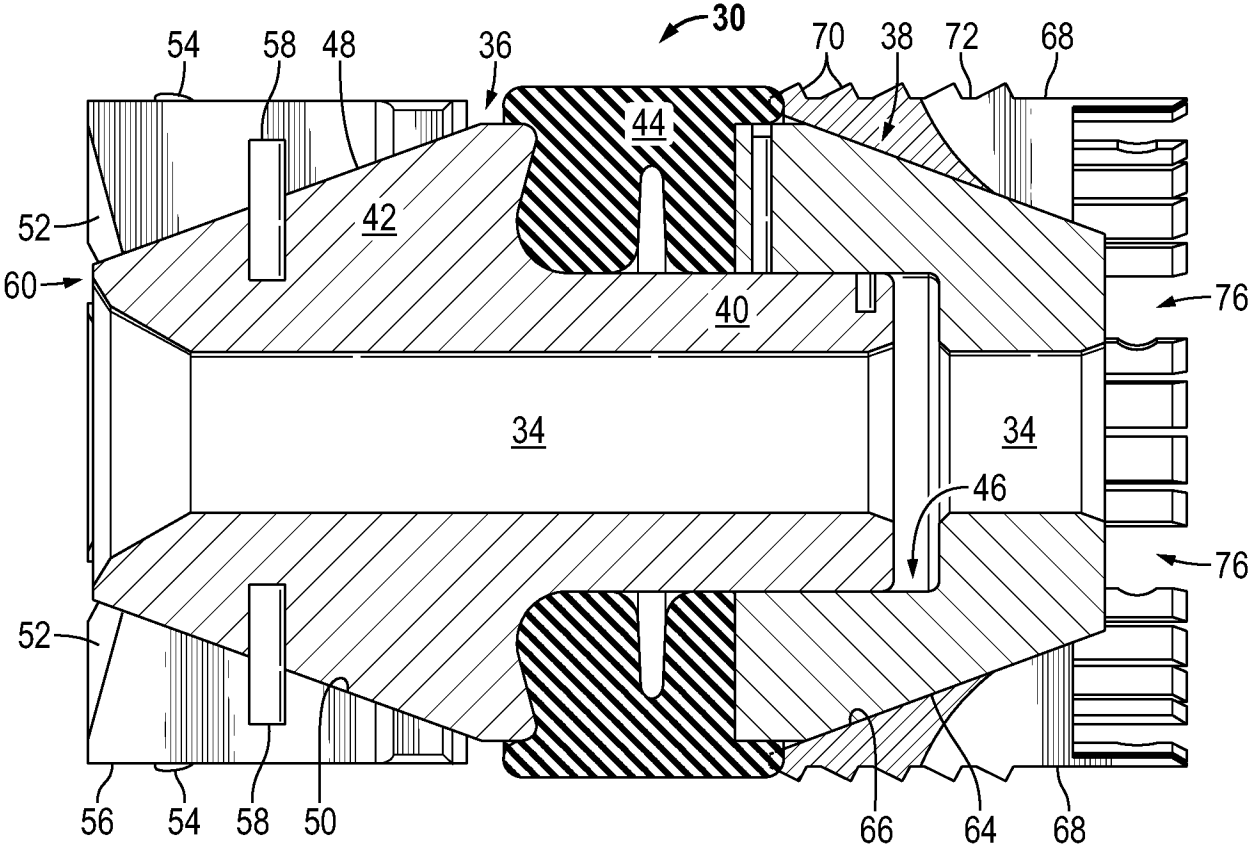
FIG. 5 is a cross-sectional view of the plug illustrated in FIG. 4, according to an embodiment of the disclosure.

The plug 30 may be conveyed downhole through wellbore 26 while in the radially contracted position, as illustrated in FIGS. 2 and 3. Once the plug 30 is at the appropriate location, the plug 30 is actuated to a radially expanded configuration, as illustrated in FIGS. 4 and 5. The actuation may be performed via a plug tool as with conventional frac/bridge plugs or with other suitable mechanisms or techniques able to longitudinally compress the plug 30 so as to cause radial expansion of sealing element 44 and slips 52, 68. During actuation to the radially expanded configuration, the bridge portions 62 for both the upper slips 52 and the lower slips 68 are released, e.g. fractured (see FIG. 4). The fracturing of the bridge portions 62 occurs as the upper slips 52 and lower slips 68 are moved longitudinally, e.g. axially, against the tapered surfaces 48, 64, respectively.

As a result of the longitudinal movement, the tapered surfaces 48, 64 force the slips 52, 68 radially outwardly until their teeth 54, 70 engage the surrounding well casing 32. Simultaneously, the extended portion 40 of upper cone 36 is forced farther into recess 46 of lower cone 38 to effectively squeeze sealing element 44. The squeezing of sealing element 44 forces the sealing element 44 to expand radially outwardly and into sealing engagement with the surrounding well casing 32.

The configuration and use of lower slips 68 enables construction of plug 30 without an expandable backup ring. In the illustrated configuration, the lower cone 38 is placed immediately adjacent the sealing element 44 so the lower tapered surface 64 of lower cone 38 extends relatively closely to, e.g. touches, the resilient sealing element 44. By way of example, the lower cone 38 may be bonded to the sealing element 44 via a suitable adhesive or other bonding agent.

As the plug 30 is longitudinally compressed, the lower slips 68 ride up the tapered surface 64 of lower cone 38 and expand in a radially outward direction. Once the lower slips 68 have set into the casing 32, the lower slips 68 form a nearly complete ring with minor extrusion gaps between the individual slips 68. The nearly complete ring is sufficient to stop extrusion of the sealing element 44 at a wide range of temperatures. In some extremely high temperature applications, the sealing element 44 may be formed of a higher durometer rubber, a secondary backup system may be added, and/or a greater number of slips may be employed to help prevent extrusion and to maintain the integrity of the seal.

The construction of the upper slips 52 and lower slips 68 also enables the slidable coupling of slips 52, 68 into plug 30 while also enhancing an even break-out, e.g. separation, of the slips 52, 68 (with the aid of retention members 58, 74) during actuation of plug 30 to the radially expanded configuration. The slips 52, 68 may be constructed with their corresponding slots 60, 76 extending from an axially outward end toward an axially inward end until reaching bridge portions 62. This type of construction enables the slips 52, 68 to be slidably supported and held on their corresponding tapered surfaces 48, 64 by retention members 58, 74. The retention members 58, 74 acting along corresponding slots 60, 76 further ensure the bridge portions 62 are fractured in an even break-out during transition of the plug 30 to the radially expanded configuration (see FIGS. 4 and 5). In other words, the bridge portions 62 hold the slips 52, 68 in place while plug 38 is in the radially contracted configuration. Then, the retention members 58, 74, in cooperation with slots 60, 76, help ensure even fracturing of desired bridge portions 62 so the corresponding slips 52, 68 separate uniformly (not at a single location or at a limited number of locations) during radial expansion of plug 30.

Figure 6:
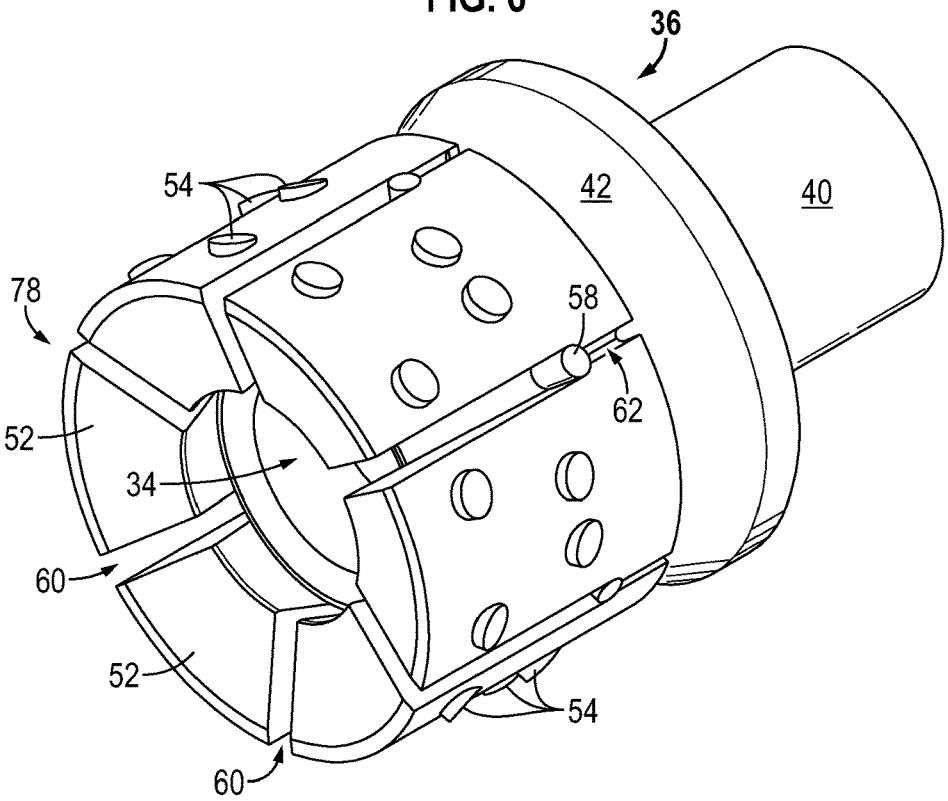
FIG. 6 is an orthogonal view of an example of the plug showing upper slips mounted on an upper cone, according to an embodiment of the disclosure.
Figure 7:
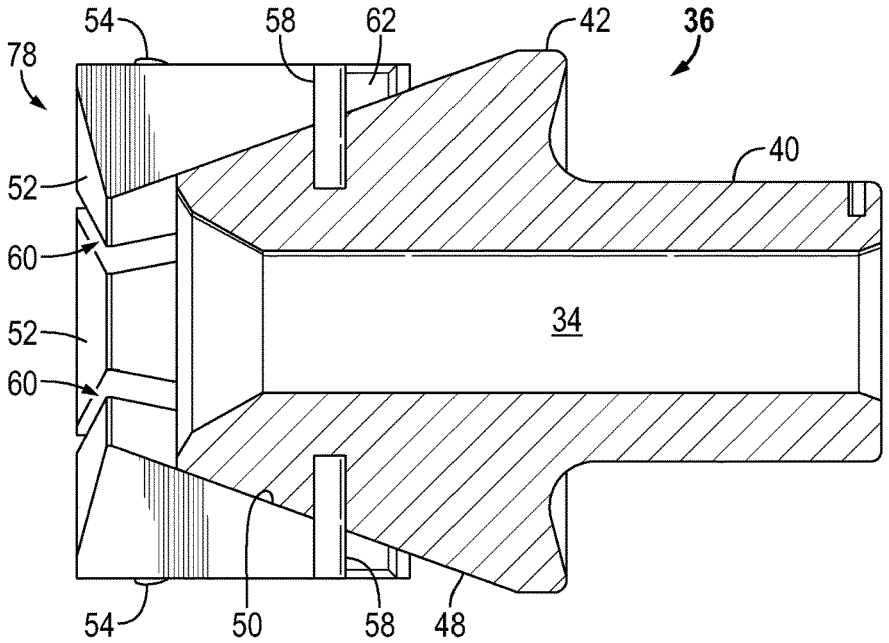
FIG. 7 is a cross-sectional view of the plug illustrated in FIG. 6, according to an embodiment of the disclosure.

In FIGS. 6 and 7, an example of slip construction is illustrated with respect to the upper slips 52 although a similar construction may be used for lower slips 68. As illustrated, the slots 60 extend inwardly in a longitudinal direction from an axially outer end 78 until reaching bridge portions 62. In other words, the slots 60 extend from a thick end of the upper slips 52 toward a thin end of the upper slips 52. The same type of construction may be used for lower slips 68.

The bridge portions 62 may comprise separate components holding the adjacent upper slips segments 52 together while in the radially contracted configuration. However, the bridge portions 62 also may be integrally formed with the upper slips 52 by, for example, cutting, casting, or otherwise forming slots 60 partially through the material forming upper slips 52. In this latter example, the partial formation of slots 60 through the material of upper slips 52 effectively leaves bridge portions 62.

The retention members 58 may be formed as pins or other suitable members sized for receipt in slots 60 in a manner such that interference with bridge portions 62 retains the slips 52 during, for example, assembly, shipping, and handling. The retention members 58 also ensure an even break-out of the slips 52 by forcing breakage of the corresponding bridge portion 62 between slips 52. Depending on the application, the retention members/pins 58 may be formed of metal for strength or from weaker plastic or composite materials for ease of milling. By using retention members 58, the slips 52 are prevented from sliding backwards off cone portion 42. Thus, the combination of members 58 and bridge portions 62 securely hold slips 52 without the addition of other features such as surrounding components or a central mandrel to keep the components locked together. As described above, retention members 58 then further interact with slots 60 during radial expansion of plug 30 to ensure relatively uniform breakage of bridge portions 62 and thus a more even break-out of slips 52 during setting of plug 30.

The illustrated configuration of slips 52 and retention members 58 enables a substantial reduction in the length of the plug 30 while also reducing the number of components that would otherwise be used in constructing a conventional frac or bridge plug. Furthermore, the use of slots 60 in combination with bridge portions 62 ensures that each slip segment 52 is forced to split apart from its adjacent slips 52 as they travel up tapered surface 48. It should be noted that similar arrangements may be used with lower slips 68, retention members 74, and the corresponding lower tapered surface 64.

Figure 8:
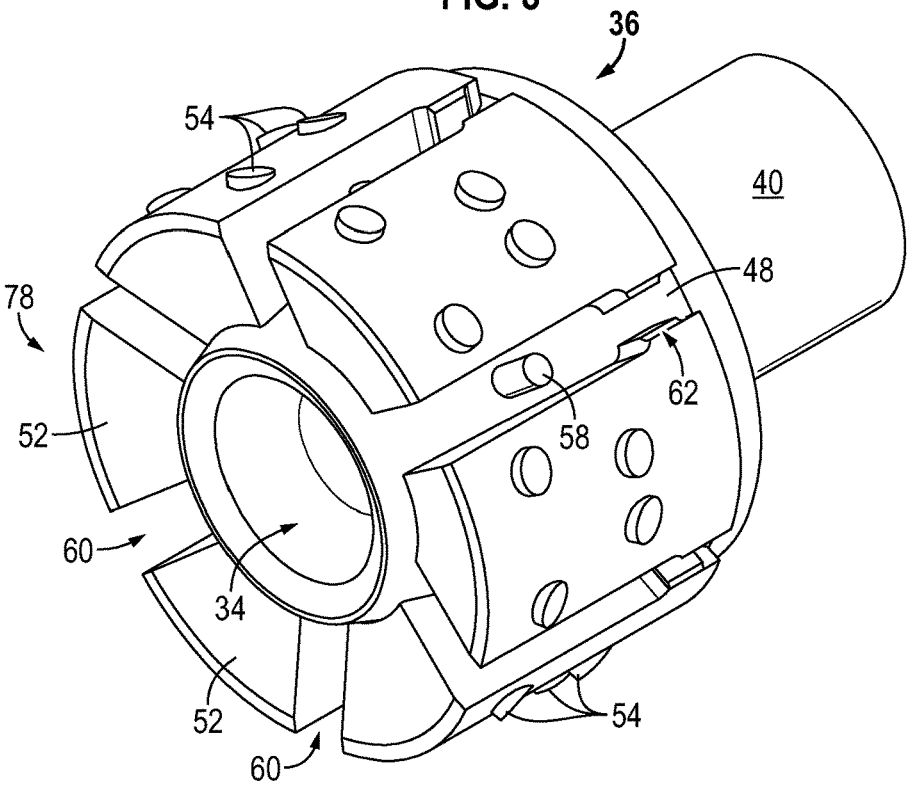
FIG. 8 is an orthogonal view of the plug similar to that illustrated in FIG. 6 but showing the plug in a different operational configuration, according to an embodiment of the disclosure.
Figure 9:
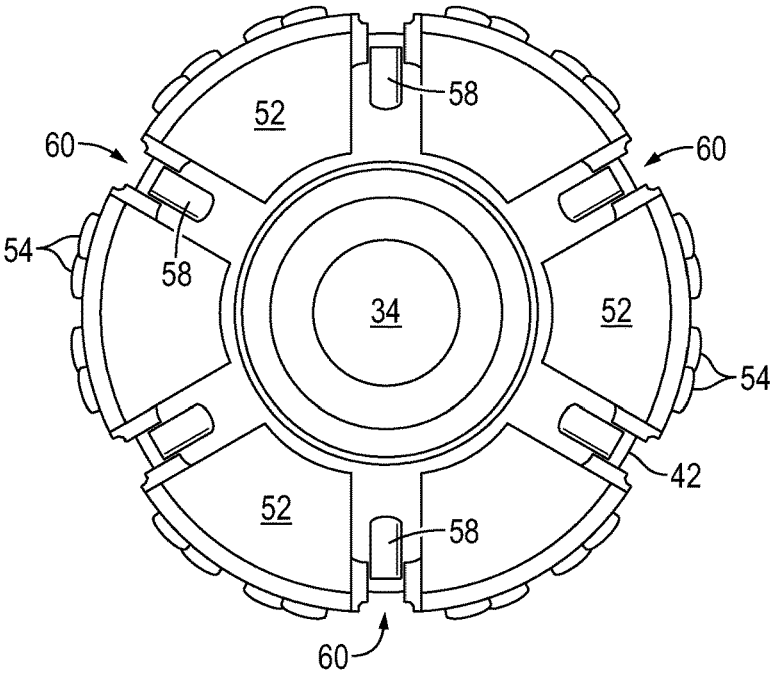
FIG. 9 is a front view of the plug illustrated in FIG. 8, according to an embodiment of the disclosure.

Referring generally to FIGS. 8 and 9, the upper slips 52 have been illustrated as shifted along upper tapered surface 48 to their actuated or radially expanded configuration. As illustrated, movement of slips 52 longitudinally against cone portion 42 causes tapered surface 48 of upper cone 36 and corresponding internal tapered surfaces 50 of slips 52 to force the slips 52 in the radially outward direction. This movement causes the fractures between adjacent slips 52 at bridge portions 62 as described above.

During radial expansion as plug 30 is actuated, the substantially uniform separation between adjacent slips 52 ensures balanced expansion and engagement of plug 30 with respect to the surrounding casing 32. As the slips 52 are driven along tapered surface 48, the pins or other retention members 58 disposed within slots 60 hold the circumferential positions of the adjacent slips 52 until fracture. The inability of the slips to shift circumferentially, due to the pins 58, eventually forces the entire number of bridge portions 62 to fracture. However, the point of fracture may depend on, for example, the clearance between the pins/retention members 58 and the corresponding walls forming slots 60.

Figure 10:
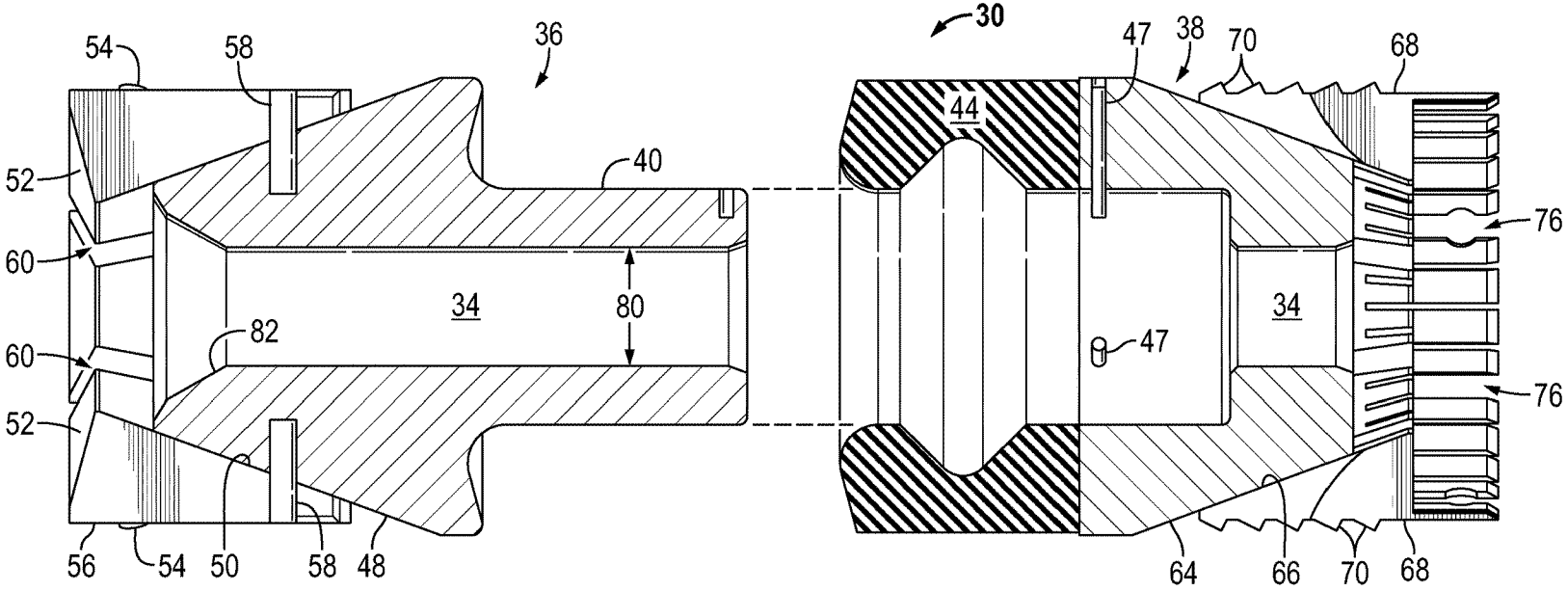
FIG. 10 is an exploded view of an example of the upper cone positioned for insertion into engagement with the flexible element and the lower cone, according to an embodiment of the disclosure.
Figure 11:
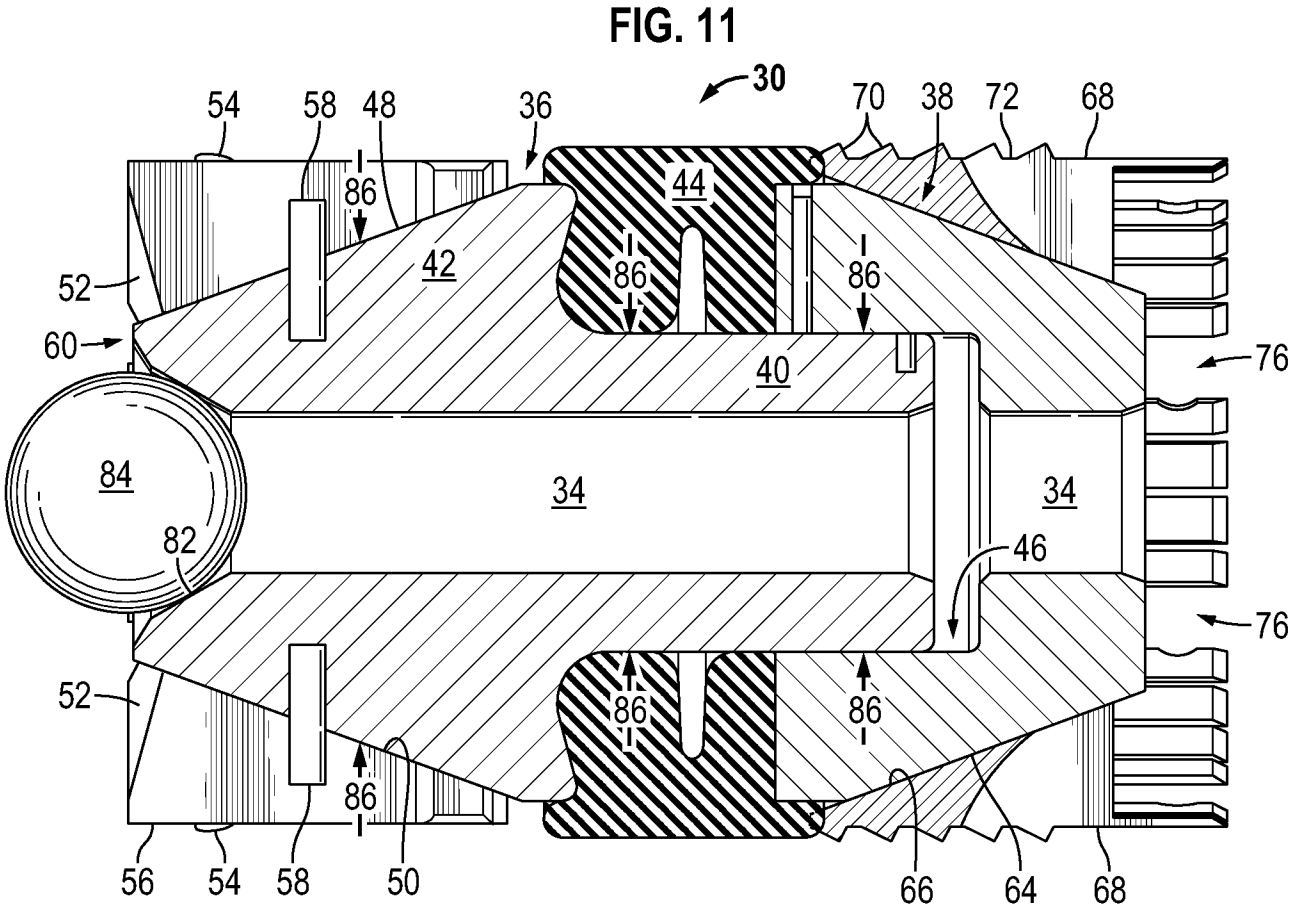
FIG. 11 is a cross-sectional view of the assembled plug with a received ball to facilitate actuation of the plug, according to an embodiment of the disclosure.

The configuration of plug 30 also enables elimination of a conventional plug mandrel which otherwise serves as the central component upon which components are fitted and held in place in a conventional frac or bridge plug. With additional reference to FIGS. 10 and 11, embodiments of plug 30 utilize upper cone 36 in performing various functions, such as allowing/inhibiting fluid flow, aligning components, and supporting radial load. As illustrated in FIG. 10, upper cone 36 may be constructed with a reduced inner diameter 80 which effectively forms an inner diameter of the entire plug 30. Additionally, the upper cone 36 may be formed with a ball seat 82 positioned at, for example, a top end of the upper cone so that a ball 84 may land and seal against the ball seat 82, as illustrated in FIG. 11.

Furthermore, the extended portion 40 may be constructed with sufficient length so that it passes through the sealing element 44 and is received in a recess 46 of lower cone 38. This allows the upper cone 36 to be used for aligning the components of plug 30 and for supporting those components. It should be noted that at least some of the features of upper cone 36, e.g. extended portion 40, can be formed as part of lower cone 38 or as a rigid segment within sealing element 44.

As briefly referenced above, the upper cone 36 with its extended portion 40 also provides a centering and alignment function with respect to other components, e.g. sealing element 44 and lower cone 38. As illustrated in FIG. 11, the upper cone 36 and its extended portion 40 also provide substantial support against radially inward loading, represented by arrows 86, during fracturing operations and certain other types of operations. Thus, the upper cone 36 can be used to prevent the inward collapse of cooperating plug components, such as sealing element 44 and lower cone 38. Because the upper cone 36 extends into the other components of plug 30, the plug components are held concentrically relative to each other which can be beneficial during a variety of activities. For example, the upper cone 36 is able to secure other components in a manner which prevents them from vibrating loose during certain vibration inducing downhole operations, such as downhole milling operations.

Plugs 30 may be used with many types of well strings in many types of applications. For example, at least one plug 30 may be deployed downhole to facilitate fracturing operations. However, the plug or plugs 30 also may be used in other types of well strings and other types of well applications to selectively isolate portions of a wellbore. Although the plugs are commonly used in vertical wellbores, various adaptations of the plug also may be used in deviated, e.g. horizontal, wellbores.

The plug 30 may be constructed with additional components or other components depending on the parameters of a given application. The configurations and materials selected for constructing various components of plug 30 also may vary according to the parameters of a given environment or downhole operation. For example, the sealing element 44 may be constructed in various configurations with various types of rubbers or other resilient materials suitable for downhole operations. The size and number of upper slips and lower slips, as well as the angle of the cooperating tapered surfaces also may be adjusted to accommodate various applications and environments. The retention members may be positioned between each adjacent pair of slips or between selected slips to achieve a desired even break-out during radial expansion of the plug.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a well tubing having a plug deployed in a wellbore lined by a well casing, the plug being radially expandable and comprising:

a cone portion disposed in cooperation with an extended portion;

a sealing element mounted around the extended portion adjacent to the cone portion;

a plurality of slips slidably mounted on the cone portion, the plurality of slips being joined by bridge portions which establish slots between the slips; and a plurality of retention members disposed in the slots such that interference between the retention members and the bridge portions retains the plurality of slips on the cone portion until the plug is radially expanded, the plurality of retention members operating along the slots during radial expansion of the plug to cause even break-out of the plurality of slips.

2. The system as recited in claim 1, wherein the cone portion is an upper cone portion and the extended portion is affixed to the upper cone portion.

3. The system as recited in claim 2, wherein the plug further comprises a lower cone to which a plurality of lower slips is slidably mounted.

4. The system as recited in claim 3, wherein the extended portion is slidably received in a recess of the lower cone.

5. The system as recited in claim 4, wherein the plurality of lower slips is held on the lower cone by a plurality of lower retention members received in slots between the lower slips until the plug is radially expanded.

6. The system as recited in claim 5, wherein the sealing element is adjacent to the lower cone.

7. The system as recited in claim 1, wherein the plurality of retention members comprises pins secured to the cone portion and extending into the slots between the slips of the plurality of slips.

8. The system as recited in claim 1, wherein the bridge portions are fractured when the plug is radially expanded.

9. The system as recited in claim 4, wherein the plug is radially expanded by moving the extended portion farther into the recess of the lower cone.

10. A device for use in a well, comprising:

a plug selectively actuatable between a radially contracted configuration and a radially expanded configuration via longitudinal manipulation of the plug, the plug comprising:

an upper cone portion;

a lower cone;

an extended portion positioned in cooperation with the upper cone portion and the lower cone;

a sealing element mounted around the extended portion between the upper cone portion and the lower cone;

slips slidably mounted on the upper cone portion and the lower cone, the slips having slots therebetween; and retention members secured to the upper cone portion and the lower cone and located within the slots between the slips, the retention members to retain the slips on the upper cone portion and the lower cone while the plug is in the radially contracted configuration, and operated along the slots to force even break-out of the slips as the plug is actuated to the radially expanded configuration.

11. The system as recited in claim 10, wherein the slips slidably mounted on the upper cone portion are connected together by bridge portions when the plug is in the radially contracted configuration.

12. The system as recited in claim 11, wherein the slips slidably mounted on the lower cone are connected together by bridge portions when the plug is in the radially contracted configuration.

13. The system as recited in claim 12, wherein the bridge portions are frangible and fracture as the plug is transitioned to the radially expanded configuration.

14. The system as recited in claim 12, wherein the bridge portions are sized to create the slots between the slips for receiving the retention members.

15. The system as recited in claim 10, wherein the upper cone portion is affixed to the extended portion and the lower cone comprises a recess for slidably receiving the extended portion.

16. The system as recited in claim 10, wherein the retention members are in the form of pins.

17. A method, comprising:

forming a plug for sealing against a surrounding tubular surface by providing a first cone with an extended portion slidably received in a second cone;

mounting a sealing element around the extended portion between the first cone and the second cone;

positioning a first set of slips on a tapered surface of the first cone and a second set of slips on a tapered surface of the second cone; and securing the first set of slips and the second set of slips via retention members disposed in slots of the first set of slips and the second set of slips mounted to the first cone and the second cone respectively, the first set of slips and the second set of slips configured to separate upon movement of the retention members in the slots of the first set of slips and the second set of slips when the plug is set.

18. The method as recited in claim 17, further comprising actuating the plug by moving the first cone and the second cone toward each other until the first set of slips, the second set of slips, and the sealing element are forced radially outwardly against the surrounding tubular surface.

19. The method as recited in claim 17, further comprising joining the first set of slips to each other by bridge portions.

20. The method as recited in claim 17, further comprising forming the sealing element from a rubber material.

* * * * *